US006979058B1

(12) United States Patent
Beaty

(10) Patent No.: US 6,979,058 B1
(45) Date of Patent: Dec. 27, 2005

(54) LEG SUPPORT ACCESSORY FOR A SHOWER CHAIR

(76) Inventor: William A. Beaty, 5617 W. 43rd. Ave., Amarillo, TX (US) 79109

( * ) Notice: Subject to any disclaimer, the term of this patent is extended or adjusted under 35 U.S.C. 154(b) by 0 days.

(21) Appl. No.: 11/194,161

(22) Filed: Aug. 2, 2005

(51) Int. Cl.[7] ..... A47C 7/52
(52) U.S. Cl. ..... 297/423.4; 297/188.2; 248/219.1; 280/304.1
(58) Field of Search ..... 297/188.2, 411.23, 297/423.1, 423.39, 423.4; 280/304.1; 248/215, 248/219.1

(56) References Cited

U.S. PATENT DOCUMENTS 2,746,527 A * 5/1956 Liebich ..... 248/215
2,826,242 A * 3/1958 Thompson ..... 297/423.26
3,580,631 A * 5/1971 Murcott ..... 297/155
3,586,276 A * 6/1971 O'Mahoney ..... 248/128
3,891,268 A * 6/1975 Taylor ..... 297/423.1
4,403,786 A * 9/1983 Ulics ..... 297/188.2
5,040,813 A * 8/1991 Cumbie ..... 297/162
5,356,059 A * 10/1994 Yanez et al. ..... 297/188.2
5,378,041 A * 1/1995 Lee ..... 297/391

* cited by examiner

*Primary Examiner*—Peter R. Brown
(74) *Attorney, Agent, or Firm*—Norman Rainer

(57) ABSTRACT

A leg support accessory releasibly interactive with a hospital shower room chair is provided as an integral structure fabricated of PVC pipe and fitting components. The accessory includes an elongated leg rest section adapted to extend horizontally forward of the seat of the chair. An upper support member extends upwardly from the leg rest section and rearwardly to engage a front leg of the chair. A lower support member extends downwardly from the leg rest section to engage a crossbar that extends horizontally between the front legs of the chair.

6 Claims, 4 Drawing Sheets

LEG SUPPORT ACCESSORY FOR A SHOWER CHAIR

BACKGROUND OF THE INVENTION

1. Field of the Invention

This invention concerns a device for supporting a seated patient's leg, and more particularly, relates to a leg supporting device removably associated with a chair employed for shower room use as in a hospital.

2. Description of the Prior Art

For various medical reasons, there are situations wherein hospitalized patients cannot bend a knee. Although this disability is easily accommodated while the patient remains in bed, there are considerable difficulties in transporting the patient to a shower room. During such transport, it is generally preferred that the patient be seated, with the leg supported in a substantially horizontally extended position. While in the shower, it is essential that the patient remain seated.

Although a conventional wheelchair might provide the requisite transport in seated position, wheelchairs of rigid construction having leg rests are of considerable expense, and not adapted to survive frequent exposure to soapy water. Chairs specially adapted for use in hospital shower rooms are available. Such chairs are generally of all plastic construction, typically fabricated of rigid polyvinylchloride (PVC) pipe components and interactive PVC coupling components. One such plastic shower room chair currently in widespread use is manufactured by the Rubbermaid Commercial Products Company of Winchester, Va. However, such shower room chairs are not equipped with leg supporting means, the reason presumably being that the majority of patients do not require leg support in the course of their use of the chair in the shower room. Accordingly, in the interests of maintaining a low chair weight and minimal manufacturing cost, leg support means are not incorporated into the chair construction.

It is therefore a primary object of the present invention to provide a leg support accessory, which is removably attachable to a hospital shower room chair of PVC pipe construction.

It is a further object of this invention to provide a leg support accessory of the foregoing object which is of durable construction, easily installed onto said chair, and amenable to low cost manufacture.

These objects and other objects and advantages of the invention will be apparent from the following description.

SUMMARY OF THE INVENTION

The above and other beneficial objects and advantages are accomplished in accordance with the present invention by a leg support accessory for a hospital shower room chair, said chair fabricated in part of PVC pipe components and comprised of a horizontally disposed seat area having a substantially rectangular perimeter bounded by front, rear and opposed side extremities, upright members disposed at the front and rear corners of said seat area and extending to lower extremities below said seat area and upper extremities above said seat area, and a front horizontal crossbar interconnecting said front upright members below said seat area, said leg support accessory adapted to interact with either said left or right front upright member, and comprising:

1) a leg rest section elongated between forward and rearward extremities, and further bounded by inner and outer parallel side extremities and upper and lower portions, 2) an upper support member extending upwardly from said outer side extremity, thence extending rearwardly to releasable engagement with the associated left or right front upright member of said chair,
3) a lower support member extending downwardly from said leg rest section to releasable engagement with said front horizontal crossbar, and
4) abutment means extending rearwardly from said leg rest section and adapted to contact said upright member below said upper support member and in opposition thereto in a manner such that said abutment means and upper support member embrace said front upright member.

The leg support accessory is preferably fabricated substantially entirely of commonly available standard PVC pipe and fittings which are assembled by way of PVC pipe adhesive.

The shower chair preferably has four crossbar members. The upper extremities of the rear left and right upright members preferably hold bridging backrest means. Coaster-type small wheels are preferably associated with the lower extremities of the four upright members. Armrest means may extend between the front and rear upright members above the seat area.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
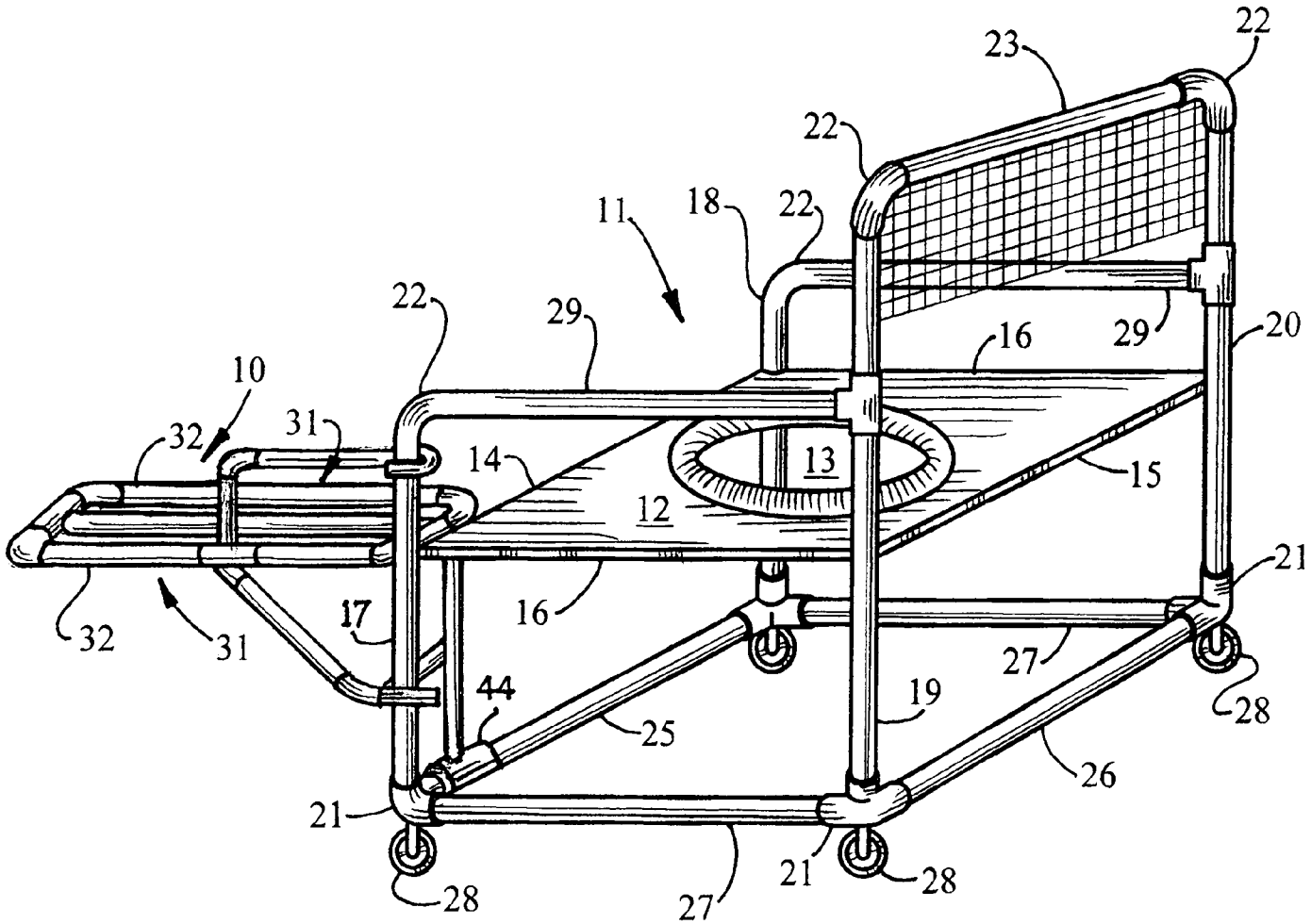
FIG. 1 is a perspective view of an embodiment of the leg support accessory of the present invention adapted to support a patient's left leg, and shown in functional association with a hospital shower room chair of PVC pipe construction.
Figure 2:
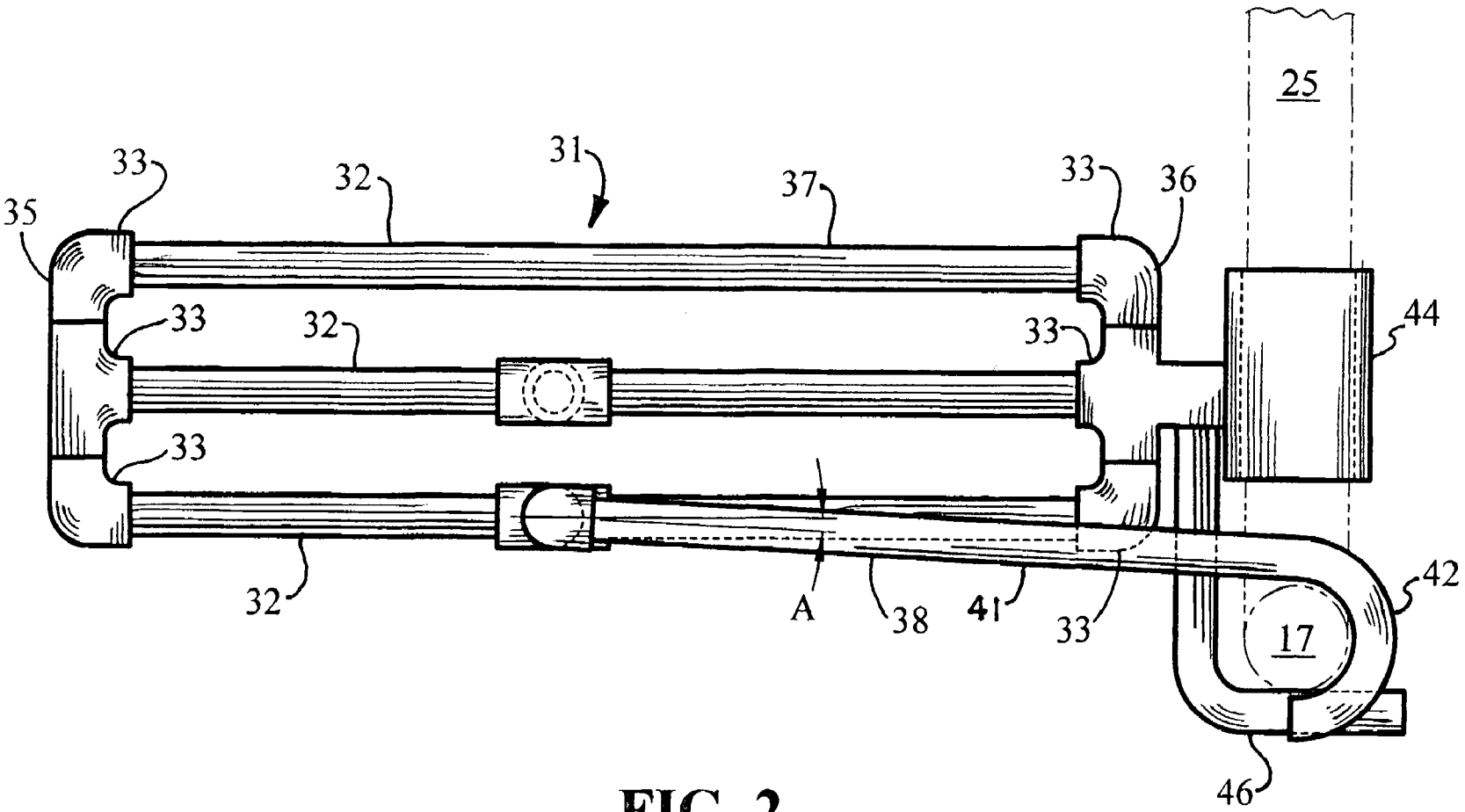
FIG. 2 is a top view of the leg support accessory of FIG. 1.
Figure 3:
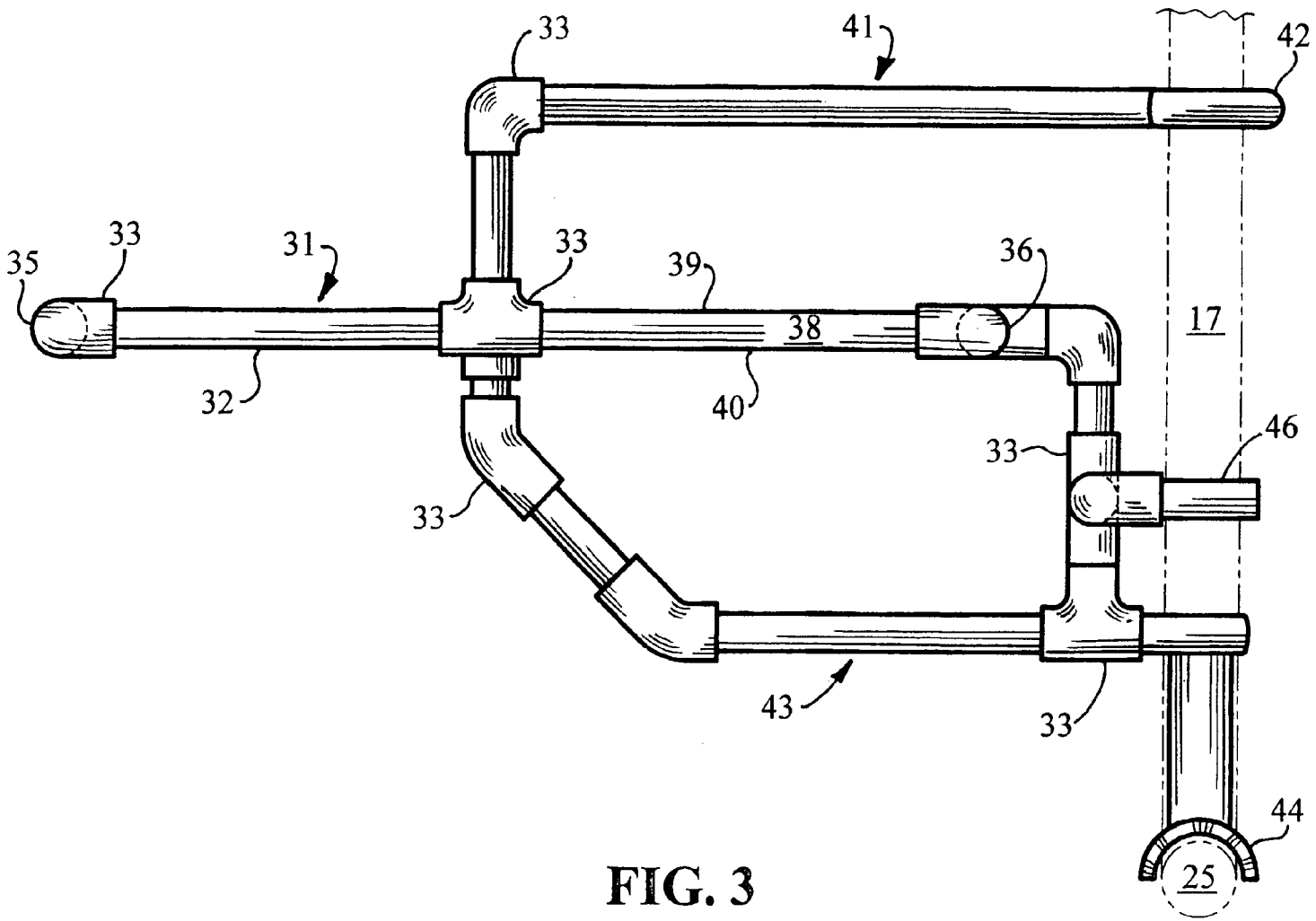
FIG. 3 is a side view of the embodiment of FIG. 1.

Referring now to FIGS. 1–4, an embodiment of the leg support accessory 10 of the present invention, fabricated of PVC pipe components, is shown in functional relationship with a hospital shower room chair 11, also fabricated of PVC pipe components interconnected by way of adhesive.

Chair 11 has a horizontally disposed seat area exemplified as platform 12 which may include a toilet opening 13 adapted to interact with a bed pan (not shown) positioned beneath said opening. Platform 12 is shown to have a substantially rectangular perimeter comprised of front and rear extremities 14 and 15, respectively, and opposed side extremities 16. Paired left and right front upright members, 17 and 18, respectively, and paired left and right rear upright members, 19 and 20, respectively, are disposed at the four corners of said platform. Said upright members extend between lower extremities 21 and below said platform and upper extremities 22 above said platform.

A backrest portion 23 extends between the upper extremities of said rear upright members. Horizontal crossbars interconnect said upright members below said platform, said crossbars being arranged as front and rear crossbars 25 and 26, respectively, and side crossbars 27. Coaster-type wheels 28 are disposed beneath the lower extremity of each upright member. Horizontal armrest members 29 extend between said front and rear upright members above said seat platform. The expressions "left" and right," as employed herein have reference to the location of the patient's left and right legs when seated within said shower room chair. The PVC pipe and components are preferably "Schedule 40", white.

Leg support accessory 10 is fabricated in a manner to releasibly engage either the right or left side of chair 11 forwardly of seat platform 12. The illustrated leg support accessory, constructed to engage the left side of the chair for supporting the patient's left leg, includes a leg rest section 31 adapted to extend horizontally forward of the seat platform and substantially coplanar therewith.

In the exemplified embodiment, three pipe segments 32 are interconnected by coupling elements 33 to produce leg rest section 31 elongated between forward and rearward extremities 35 and 36, respectively, and further bounded by inner and outer parallel side extremities 37 and 38, respectively, and upper and lower portions 39 and 40, respectively.

An upper support member 41 extends upwardly from outer side extremity 38, thence extends rearwardly to a distal extremity 42 adapted to releasibly engage left front upright member 17 of chair 11. Said distal extremity preferably has a hook configuration adapted to partially embrace upright member 17.

A lower support member 43 extends downwardly from the lower portion of leg rest section 31 to gripping extremity 44 adapted to releasibly engage front crossbar 35 of said chair. Gripping extremity 44 preferably has a semi-cylindrical contour, as may be produced by longitudinally sectioning a piece of PVC pipe. Such contour enables extremity 44 to partially embrace said crossbar.

Figure 4:
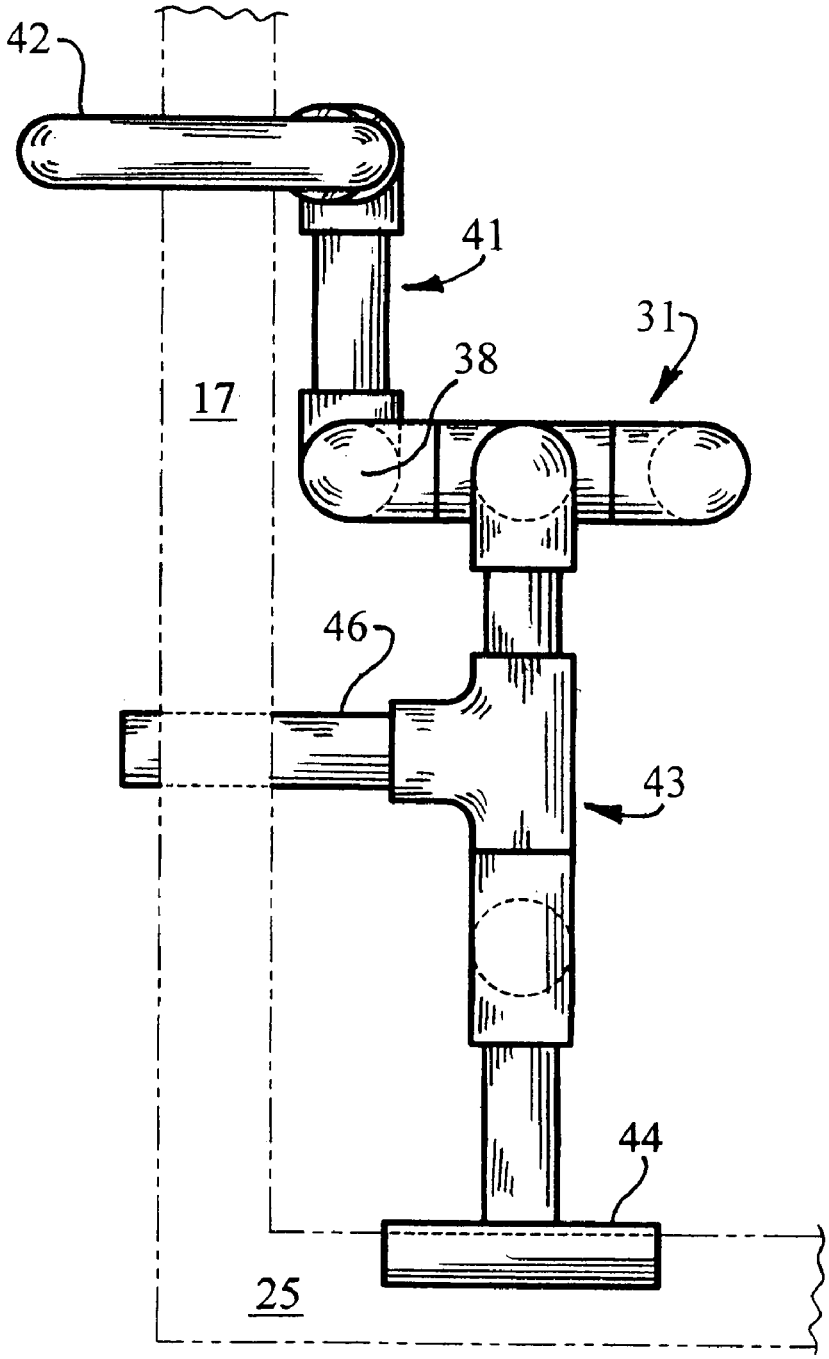
FIG. 4 is a rear view of the embodiment of FIG. 1.

An abutment post 46 is installed upon lower support member 43 in the space between leg rest section 31 and gripping extremity 44, as best shown in FIG. 4. Its function is to contact said front upright member 17 on a side thereof which is opposite to the side contacted by distal extremity 42 of said upper support member.

By virtue of the aforesaid components and their interaction, the leg support accessory device of the present invention is caused to have a unitary structure with substantially no moving parts. There is, however, a certain amount of flexibility in the structure. When installing the accessory device onto a hospital shower chair, distal extremity 42 and abutment post 46 snap in place onto front upright member 17. Such effect, permitted by the flexibility of the accessory device, causes the device to be stabilized with respect to movement in a vertical direction. Such emplacement of distal extremity 42 and abutment post 46 is further facilitated by the mounting of upper support 41 in a manner outwardly angled from leg rest section 31, as shown by angle A in FIG. 2, said angle being between 5 and 7 degrees.

The concertive action of gripping extremity 44 on crossbar 25 prevents movement of the accessory device in a horizontal direction, thereby completing the securement of the accessory device upon the shower room chair. An embodiment of the leg support accessory adapted to support a patient's right leg will be of mirror-image construction with respect to the herein exemplified embodiment for supporting the left leg.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A leg support accessory for a hospital shower room chair, said chair fabricated in part of PVC pipe components and comprised of a horizontally disposed seat area having a substantially rectangular perimeter bounded by front, rear and opposed side extremities, upright members disposed at the front and rear corners of said seat area and extending to lower extremities below said seat area and upper extremities above said seat area, and a front horizontal crossbar interconnecting said front upright members below said seat area, said leg support accessory adapted to interact with either said left or right front upright member, and comprising:

a) a leg rest section elongated between forward and rearward extremities, and further bounded by inner and outer parallel side extremities and upper and lower portions, b) an upper support member extending upwardly from said outer side extremity, thence extending rearwardly to releasable engagement with the associated left or right front upright member of said chair, c) a lower support member extending downwardly from said leg rest section to releasable engagement with said front horizontal crossbar, and d) abutment means extending rearwardly from said leg rest section and adapted to contact said upright member below said upper support member and in opposition thereto in a manner such that said abutment means and upper support member embrace said front upright member.

2. The leg support accessory of claim 1 fabricated substantially entirely of PVC pipe and fittings, and assembled by way of PVC pipe adhesive.

3. The leg support accessory of claim 2 wherein said leg rest section is comprised of several lengths of PVC pipe in parallel juxtaposition.

4. The leg support accessory of claim 1 wherein said upper support member terminates rearwardly in a distal extremity having a hook configuration.

5. The leg support accessory of claim 4 wherein said lower support member terminates downwardly in a gripping extremity having a semi-cylindrical contour conforming to the contour of the engaged crossbar.

6. The leg support accessory of claim 1 having a unitary structure with substantially no moving parts but having sufficient flexibility to facilitate installation upon said chair.

* * * * *